US008366841B2

(12) United States Patent
Peng et al.

(10) Patent No.: US 8,366,841 B2
(45) Date of Patent: Feb. 5, 2013

(54) LEAD-FREE FREE-CUTTING CORROSION-RESISTANT SILICON-BISMUTH BRASS ALLOY

(75) Inventors: Feng Peng, Yuyao (CN); Baoping Xia, Yuyao (CN); Jianping Liu, Yuyao (CN); Bin Feng, Yuyao (CN); Changshun Zheng, Yuyao (CN); Wenjian Liu, Yuyao (CN)

(73) Assignees: Ningbo Xingaoda Advanced Metallic Materials Co., Ltd, Yuyao (CN); Ningbo Aoda New Metal Materials Co., Ltd, Ningbo (CN)

( * ) Notice: Subject to any disclaimer, the term of this patent is extended or adjusted under 35 U.S.C. 154(b) by 0 days.

(21) Appl. No.: 13/243,754

(22) Filed: Sep. 23, 2011

(65) Prior Publication Data

US 2012/0251382 A1 Oct. 4, 2012

(30) Foreign Application Priority Data

Jan. 11, 2011 (CN) ..... 2011 1 0006965

(51) Int. Cl.
*C22C 9/04* (2006.01)

(52) U.S. Cl. ..... 148/434; 420/478; 420/479

(58) Field of Classification Search ..... 148/434; 420/478, 479
See application file for complete search history.

(56) References Cited

U.S. PATENT DOCUMENTS 6,942,742 B2 * 9/2005 Yamagishi ..... 148/433

FOREIGN PATENT DOCUMENTS

JP 2004285449 A * 10/2004

* cited by examiner

*Primary Examiner* — Sikyin Ip
(74) *Attorney, Agent, or Firm* — Morrison & Foerster LLP

(57) ABSTRACT

A lead-free free-cutting corrosion-resistant silicon-bismuth brass alloy, including the following: between 60.0 and 65.0 wt % of Cu, between 0.6 and 1.8 wt % of Si, between 0.2 and 1.5 wt % of Bi, between 0.02 and 0.5 wt % of Al, less than 1.5 wt % of Ni+Mn+Sn, between 0.01 and 0.5 wt % of La—Ce alloy, between 0.002 and 0.02 wt % of B, with the remainder being Zn and inevitable impurities, wherein the total amount of impurities are no more than 0.5 wt %.

12 Claims, No Drawings

LEAD-FREE FREE-CUTTING CORROSION-RESISTANT SILICON-BISMUTH BRASS ALLOY

CROSS-REFERENCE(S) TO RELATED APPLICATION(S)

This application claims priority to Chinese Patent Application No. 201110006965.8, filed Jan. 11, 2011, which is hereby incorporated by reference in the present disclosure in its entirety.

TECHNICAL FIELD

The present generally relates to the field of the alloy material, more particularly to a lead-free free-cutting corrosion-resistant silicon-bismuth brass alloy.

BACKGROUND ART

The lead brass has been widely used to sanitary hardware, water heating, valves etc. since it has excellent corrosion resistance, cuttability and hot and cold workability. However, because the lead contained in brass tends to dissolve into water and contaminates water source, soil, atmosphere, and so on, the dissolved lead easily has no harmful effect on the human body or other organisms, thus it has become a trend in the art with the development of the lead-free brass substitutes.

The currently widely used environmentally friendly lead-free free-cutting brass alloy for replacing lead brass in Chinese market is the bismuth brass and silicon brass. The cuttability of bismuth brass is approximately close to that of lead brass, but the apparent shortage of bismuth brass is the high sensitivity to stress corrosion due to the high residual stress resulted from growing of bismuth particles during solidification in the alloy. On the other hand, the difficulty of processing parts and components due to bad weldability of lead free bismuth brass is caused by the severe hot brittleness at the temperature between 300° C. and 450° C. (medium temperature). Therefore the reliability of welding joint at the temperature range mentioned above seems to be extremely problematic. At the same time, inefficient cooling condition can easily result in hot cracking during machining metallic parts and components. It is, therefore, difficult to use bismuth brass widely.

As an another substitute for lead brass, the advantages of silicon brass are good hot workability, weldability, dezincification-resistance and stress corrosion resistance, but in comparison with bismuth brass, silicon brass has difficulty in adjusting to high speed cutting lathe because of its shortage of low efficiency of cold processing and short service life of cutters resulted from poor cuttability. Furthermore, the lead-free silicon brass has a high content of copper, generally about between 73 and 77 wt %, even up to between 79 and 83 wt %. Thus, the cost of raw material of silicon brass is much higher than that of bismuth brass.

SUMMARY

The purposes of the present invention are to solve the problems stated above, and to provide a lead-free free-cutting corrosion-resistant silicon-bismuth brass alloy, which has no easily cracking tendency when welding at medium temperature and excellent cuttability. Compared with the silicon brass, the present alloy remains good hot workability and good dezincification-resistance as well as stress corrosion resistance, and has a low cost.

To solve the above technical problems, in the first aspect, the present invention provides a lead-free free-cutting corrosion-resistant silicon-bismuth brass alloy, wherein, based on the total weight of the alloy, the alloy is consisted of the followings: between 60.0 and 65.0 wt % of Cu, between 0.6 and 1.8 wt % of Si, between 0.2 and 1.5 wt % of Bi, between 0.02 and 0.5 wt % of Al, less than 1.5 wt % of Ni+Mn+Sn, between 0.01 and 0.5 wt % of La—Ce alloy, between 0.002 and 0.02 wt % of B, and with the remainder being Zn and inevitable impurities, wherein the total amount of impurities are no more than 0.5 wt %.

In a preferable embodiment of the present invention, the present invention provides a lead-free free-cutting corrosion-resistant silicon-bismuth brass alloy, wherein, the alloy is consisted of the followings: between 61.0 and 64.0 wt % of Cu, between 0.8 and 1.4 wt % of Si, between 0.25 and 0.6 wt % of Bi, between 0.04 and 0.25 wt % of Al, less than 1.0 wt % of Ni+Mn+Sn, between 0.02 and 0.3 wt % of La—Ce alloy, between 0.002 and 0.012 wt % of B, and with the remainder being Zn and inevitable impurities, wherein the total amount of impurities are no more than 0.5 wt %.

In a further preferable embodiment of the present invention, the present invention provides a lead-free free-cutting corrosion-resistant silicon-bismuth brass alloy, wherein, the alloy is consisted of the followings: between 62.0 and 64.0 wt % of Cu, between 0.9 and 1.3 wt % of Si, between 0.25 and 0.45 wt % of Bi, between 0.05 and 0.2 wt % of Al, less than 0.9 wt % of Ni+Mn+Sn, between 0.025 and 0.2 wt % of La—Ce alloy, between 0.003 and 0.01 wt % of B, and with the remainder being Zn and inevitable impurities, wherein the total amount of impurities are no more than 0.5 wt %.

The present alloy in the first aspect has cuttability compatible with bismuth brass, and can be cold and hot plastic working. Strength and hardness of the present alloy are higher than that of lead or bismuth brass, but approximately equivalent to that of silicon brass. Dezincification-resistance of the alloy is better than that of lead or bismuth brass, but equivalent to that of silicon brass. The present alloy is insensitive to ammonia vapor test, and no brittle crack has been found with 50% deformation and at the medium temperature between 300° C. and 400° C.

In the second aspect, the present invention provides a lead-free free-cutting corrosion-resistant silicon-bismuth brass alloy, wherein, the alloy is consisted of the followings: between 60.5 and 63.5 wt % of Cu, between 0.6 and 1.5 wt % of Si, between 0.5 and 1.2 wt % of Bi, between 0.04 and 0.25 wt % of Al, less than 1.2 wt % of Ni+Mn+Sn, between 0.02 and 0.25 wt % of La—Ce alloy, between 0.002 and 0.012 wt % of B, and with the remainder being Zn and inevitable impurities, wherein the total amount of impurities are no more than 0.5 wt %.

In preferable embodiment of the present invention, the present invention provides a lead-free free-cutting corrosion-resistant silicon-bismuth brass alloy, wherein, the alloy is consisted of the followings: between 61.0 and 63.0 wt % of Cu, between 0.6 and 1.2 wt % of Si, between 0.6 and 1.0 wt % of Bi, between 0.05 and 0.2 wt % of Al, less than 0.9 wt % of Ni+Mn+Sn, between 0.025 and 0.2 wt % of La—Ce alloy, between 0.003 and 0.01 wt % of B, and with the remainder being Zn and inevitable impurities, wherein the total amount of impurities are no more than 0.5 wt %.

The present alloy in the second aspect has cuttability compatible with HPb59-1 and C3771, and can be cold and hot plastic working. Strength and hardness of the present alloy are higher than that of silicon or bismuth brass, but lower than that of silicon brass. Dezincification-resistance of the present alloy is better than that of lead or bismuth brass, but equivalent to that of silicon brass. The present alloy is insensitive to ammonia vapor test.

In an embodiment of the present invention, the impurities have a lead-content of less than 0.01 wt %. In this case, even the lead contained in the alloy dissolves or is discharged into the water, it has little harmful effect on the human body and environment.

In one embodiment of the present invention, the La—Ce alloy has a Ce-content of 40 wt %, that is to say, the La—Ce alloy has a La-content of 60 wt %.

Further aspect of the present disclosure will become apparent from the detailed description and the claims. The detailed description and specific examples are intended for purposes of illustration only and are not intended to limit the scope of the disclosure.

DETAILED DESCRIPTION

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the specification, and the following claims.

The reason of reasonable election of alloy elements and optimized design of their content in the inventive lead-free free-cutting corrosion-resistant silicon-bismuth brass alloy lies in the followings:

Silicon is added in the present alloy for improving cuttability, hot workability, and stress corrosion resistance. Adding Si prevents it from tendency of stress corrosion cracking effectively. As to the alloy in the first aspect, the improvement of cuttability is limited for Si<0.9 wt %, and lower plasticity and cracking during deformation at media temperature when Si>1.3 wt %. Therefore, an optimizing range of Si is 0.9 to 1.3 wt % in the alloy in the first aspect. As to the alloy in the secondt aspect, insignificant improvement of catability and hot workability for Si<0.6 wt %, and negative effect on plasticity for Si>1.2 wt %. Therefore, the content of Si should be controlled in the range of 0.6 to 1.2 wt % in the secondt aspect.

Bismuth is added to improve the cuttability of the present alloy. The improving effect is limited when Bi in amounts less than 0.25 wt %, and apparently tendency of hot cracking is resulted from higher content of Bi larger than 0.45 wt %. Therefore, an optimizing range of Bi is 0.25 to 0.45 wt % in the first aspect. Based on the fact that the improving effect is limited when Bi in amounts less than 0.6 wt %, and further improving effect is not apparently and the cost becomes high when the content of Bi is higher than 1.0%, an optimizing range of Bi is 0.6 to 1.0 wt % in the second aspect.

Aluminum is added for improving corrosion resistance and hot workability. An optimizing range of Al in the aaloy is 0.05 to 0.2 wt %, because of weak improvement if Al content less 0.05 wt % and low plasticity when Al content exceeds 0.2 wt %.

La—Ce alloy is added for grain refinement and improvement of corrosion resistance, and improving properties at medium temperatures. An optimizing range of La—Ce alloy is 0.025 to 0.2 wt % due to the limited improvement when its content is smaller than 0.025 wt % and negative effect on castability when higher than 0.2 wt % respectively.

Boron is added for improving dezincificution-resistance of the alloy. No significant improvement has been found for the content of boron less than 0.002 wt %, and further improvement has not been shown when larger than 0.01 wt %. Significant improvement of dezincificution-resistance can be obtained by combination of adding tin and aluminum. At the same time, boron can refine grains of the alloy, and increase stress corrosion resistance.

Mn, Ni and Sn are added for improving dezincificution-resistance and stress corrosion resistance of the alloy. Si and Mn can improve stress corrosion resistance of $\alpha+\beta$ and $\beta$ brass. Ni and Sn are added for increasing dezincificution-resistance of the alloy. The optimizing total amount of Mn, Ni and Sn is preferablly 0.2 to 0.9 wt %.

The alloy of higher content of copper contains more a phase and has better corrosion resistance and plasticity, but its cost increased. Low plasticity will be resulted from unreasonably low copper content in the alloy. The inventive alloy contains 62.0 to 64.0 wt % Cu in the first aspect, and 61.0 to 63.0 wt % Cu in the second aspec.

Unless clearly indicated, the percent in the context means the weight percent.

The present invention has the following advantage and beneficial effects:

1. The excellent cuttability, corrosion resistance, cold and hot workability, and mechanical property are obtained due to accumulation effect by adding optimized content of Cu, Si, Bi, Mn, Ni, Sn, B, Pb, and Ce—La alloy in the inventive alloy. In comparison with the existing bismuth, lead, or silicon brass, the inventive alloy is an environmentally-friendly free-cutting material with better integrated performance.

2. In comparison with the alloy in the prior art, in addition to higher performance/price ratio, the inventive alloy possesses reserved advantages of bismuth or silicon brass, but overcame their shortages. For example, the inventive alloy has no easily cracking tendency when welding at medium temperature and excellent cuttability and stress corrosion resistance. Also, it has good hot workability and dezincification-resistance. Furthermore, the copper content of the present alloy is much lower than that of the conventional alloy, reducing the cost significantly, and improving the performance/price ratio. Therefore it is more suitable for water heating system, sanitary hardware, valves, and the area where the structure components are needed.

EXAMPLE

The further detailed description is shown in details in combination with description of examples, but the present invention is not limited to the examples.

The process for producing the inventive alloy samples are as follows:

Materials proportion-melting in main-frequency induction furnace-full continuous casting rod of Φ103 mm-hot extruded into that of Φ18 mm at 600-660° C.-peeling into that of Φ17 mm-drawing into that of Φ15 5 mm. The process for producing the inventive alloy is approximately same as that of conventional brass, in which the master alloy of Cu—Ni, Cu—Mn, and Cu—Si are used for materials proportion of Ni, Mn, and Si, and the content of the each component of the alloy is within the formulation range.

Comparative alloy shown in Table 2 is obtained by the same process as the inventive one.

Alloy composition in examples of the inventive lead-free free-cutting corrosion-resistant silicon-bismuth brass alloy is shown in Table 1

Alloy composition in comparative alloy is shown in Table 2.

Table 3 indicutes the result of dezincificution corrosion testing, which is carried out according to GB/T10119-1988 standard, titled "Determination of dezincificution corrosion resistance of brass". Parallel test is performed on the inventive alloy and comparative alloy.

Ammonia test shown in Table 3 is made on the samples according to GB/T 10567.2-2007 standard, titled "Wrought copper and copper alloy-Detection of residual stress-Ammonia test". Stress corrosion resistance is tested on samples with working rate of 16.8%. The samples are observed at a magnificution of 10 to detect if crack exists on their surface. Aqueous ammonia testing with ρ of 0.9 g/lm is made on the samples, and parallel test is performed on the inventive alloy and comparative alloy.

In deformation tests on specimens of examples at medium temperature, the size of specimens is as follows: outside diameter of ϕ32 mm, inner diameter of ϕ27.6 mm, wall thickness of round tube of 2.2 mm, and length of tube of 50 mm. Specimens are heated to the temperature of 350~400 for dwell time of 1 hour in muffle furnace, and then are taken out from the furnace. The specimens are then pressed to flat shape immediately with deformation rate of 50% to observe if crack exists in the specimens. Parallel test is performed on the inventive alloy and comparative alloy.

The procedure for measuring cuttability of ordinary copper alloy is used for cuttability evaluation of the samples, i.e. morphology of chips is utilized for a judgment on cuttability. Rotating speed of main axis, feeding quantity (feed engagement) and depth of cut are 1000 rpm/min, 0.16 mm/rev and 0.5 mm respectively. "Excellent", "good" and "poor" mean best, medium and bad cuttability respectively.

TABLE 1

Composition of samples of the inventive alloy (wt %)

| No | Cu | Si | Bi | Mn + Ni + Sn | Al | rare earth (La—Ce alloymetal) | B |
|---|---|---|---|---|---|---|---|
| 1 | 63.1 | 0.64 | 0.75 | 0.575 | 0.102 | 0.02 | 0.005 |
| 2 | 62.5 | 0.93 | 0.80 | 0.58 | 0.194 | 0.031 | 0.006 |

TABLE 1-continued

Composition of samples of the inventive alloy (wt %)

| No | Cu | Si | Bi | Mn + Ni + Sn | Al | rare earth (La—Ce alloymetal) | B |
|---|---|---|---|---|---|---|---|
| 3 | 63.0 | 1.16 | 0.319 | 0.1 | 0.091 | 0.025 | 0.005 |
| 4 | 62.63 | 1.16 | 0.334 | 0.497 | 0.115 | 0.061 | 0.0045 |
| 5 | 63.12 | 1.16 | 0.355 | 0.511 | 0.113 | 0.06 | 0.0057 |
| 6 | 62.65 | 1.19 | 0.361 | 0.5 | 0.114 | 0.058 | 0.004 |
| 7 | 63.37 | 1.15 | 0.333 | 0.505 | 0.11 | 0.059 | 0.005 |
| 8 | 63.0 | 1.15 | 0.375 | 0.497 | 0.119 | 0.058 | 0.0048 |
| 9 | 63.37 | 1.20 | 0.349 | 0.383 | 0.153 | 0.061 | 0.006 |
| 10 | 63.38 | 1.21 | 0.353 | 0.382 | 0.151 | 0.063 | 0.0045 |
| 11 | 63.47 | 1.22 | 0.341 | 0.385 | 0.15 | 0.06 | 0.0058 |
| 12 | 63.34 | 1.21 | 0.359 | 0.38 | 0.151 | 0.059 | 0.0052 |
| 13 | 63.72 | 1.23 | 0.353 | 0.383 | 0.148 | 0.062 | 0.0048 |
| 14 | 63.12 | 1.20 | 0.353 | 0.38 | 0.147 | 0.06 | 0.0047 |
| 15 | 63.01 | 0.97 | 0.344 | 0.757 | 0.134 | 0.075 | 0.006 |
| 16 | 62.71 | 1.14 | 0.315 | 0.755 | 0.137 | 0.026 | 0.0052 |

Note:

In table 1, the remainder in the alloy is Zn and inevitable impurities; Mn + Ni + Sn means that the each amount of the Mn, Ni and Sn can be modified discretionarily, with the provision that the total amount of Mn, Ni and Sn falls within the protection scope of the present invention.

TABLE 2

Composition of comparative alloy

| No | Cu | Pb | Si | Bi | Al | Fe | P | Remark |
|---|---|---|---|---|---|---|---|---|
| 20 | 57.78 | 1.66 | | | 0.022 | 0.195 | | C3771 |
| 21 | 60.73 | 2.21 | | | | 0.193 | | C3601 |
| 22 | 59.5 | | | 1.74 | 0.042 | | 0.034 | HBi59-2 |
| 23 | 80.71 | | 3.82 | | | 0.092 | 0.03 | C69400 |
| 24 | 75.23 | | 2.83 | | | 0.05 | 0.075 | C69300 |

TABLE 3

Testing results of properties for example 1 and comparative alloy 2

| | As-extruded | | | Working Rate 16.8% | | | | Deformation | | |
|---|---|---|---|---|---|---|---|---|---|---|
| Example | Tensile Strength (Mpa) | Elongation (%) | Brinell Hardness (HB) | Tensile Strength (Mpa) | Elongation (%) | Brinell Hardness (HB) | Cuttability | at Medium Temperature (300~400° C.) | Ammonia Test (16.8%) | dezincification Layer (um) |
| 1 | 400 | 33 | 90.0 | 560 | 10 | 149 | Excellent | cracking | no cracking in 24 hrs | <150 |
| 2 | 491 | 28 | 121 | 583 | 7 | 165 | Excellent | cracking | no cracking in 24 hrs | <100 |
| 3 | 500 | 28 | 124 | 610 | 7 | 168 | Excellent | no cracking | cracking after 4 hrs | <300 |
| 4 | 460 | 30 | 112 | 599 | 7 | 164 | Good | no cracking | no cracking in 24 hrs | <100 |
| 5 | 493 | 28 | 110 | 631 | 7 | 164 | Good | no cracking | no cracking in 24 hrs | <100 |
| 6 | 476 | 30 | 112 | 611 | 7 | 164 | Good | no cracking | no cracking in 24 hrs | <100 |
| 7 | 474 | 30 | 110 | 612 | 7 | 166 | Good | no cracking | no cracking in 24 hrs | <100 |
| 8 | 497 | 30 | 112 | 598 | 7 | 168 | Good | no cracking | no cracking in 24 hrs | <100 |
| 9 | 497 | 30 | 123 | 596 | 6 | 173 | Good | no cracking | no cracking in 24 hrs | <100 |
| 10 | 500 | 30 | 121 | 570 | 7 | 171 | Good | no cracking | no cracking in 24 hrs | <100 |
| 11 | 484 | 30 | 123 | 589 | 7 | 170 | Good | no cracking | no cracking in 24 hrs | <100 |

TABLE 3-continued

Testing results of properties for example 1 and comparative alloy 2

| | As-extruded | | | Working Rate 16.8% | | | | Deformation | | |
|---|---|---|---|---|---|---|---|---|---|---|
| Example | Tensile Strength (Mpa) | Elongation (%) | Brinell Hardness (HB) | Tensile Strength (Mpa) | Elongation (%) | Brinell Hardness (HB) | Cuttability | at Medium Temperature (300~400° C.) | Ammonia Test (16.8%) | dezincification Layer (um) |
| 12 | 490 | 30 | 120 | 574 | 7 | 173 | Good | no cracking | no cracking in 24 hrs | <100 |
| 13 | 500 | 30 | 123 | 583 | 7 | 174 | Good | no cracking | no cracking in 24 hrs | <100 |
| 14 | 495 | 30 | 123 | 573 | 7 | 170 | Good | no cracking | no cracking in 24 hrs | <100 |
| 15 | 495 | 30 | 112 | 593 | 7 | 166 | Poor | cracking | cracking after 8 hrs | <150 |
| 16 | 517 | 23 | 122 | 610 | 7 | 169 | Poor | no cracking | cracking after 8 hrs | <150 |
| 20 | 482 | 26 | 107 | 569 | 10 | 147 | Excellent | cracking | cracking after 4 hrs | <500 |
| 21 | 380 | 34 | 791 | 459 | 10 | 132 | Excellent | cracking | cracking after 4 hrs | <500 |
| 22 | 400 | 32 | 110 | 520 | 10 | 145 | Excellent | cracking | cracking after 4 hrs | <300 |
| 23 | 478 | 30 | 107 | 585 | 8 | 164 | Poor | no cracking | no cracking in 24 hrs | <50 |
| 24 | 563 | 28 | 130 | 626 | 6 | 177 | Poor | no cracking | no cracking in 24 hrs | <50 |

The results of testing above demonstrate that the inventive lead-free free-cutting corrosion-resistant silicon-bismuth brass alloy has equivalent cutability of lead or bismuth brass, and much better than that of silicon brass. Stress corrosion resistance and dezincificution-resistance of the alloy are much better than those of lead brass and bismuth brass, and equivalent to silicon brass. Hot workability and castability are higher than those of lead brass and bismuth brass, and equivalent to silicon brass. Comparison to easily cracking tendency when welding at medium temperature in lead or bismuth brass, welding at medium temperature can be performed in silicon-bismuth brass because content of bismuth is controlled in reasonable range. The present inventive alloy, therefore, possesses excellent integrated performance and a high performance/price ratio, and can be widely used in place of lead brass, bismuth brass and silicon brass. It is particularly applicable for water heating system, sanitary hardware, valves, and the area where the structure components are needed.

The broad teachings of the disclosure can be implemented in a variety of forms. Therefore, while this disclosure includes particular examples, the true scope of the disclosure should not be so limited since other modifications will become apparent upon a study of the specification, and the following claims.

What is claimed:

1. A lead-free free-cutting corrosion-resistant silicon-bismuth brass alloy, wherein, the alloy is consisted of the followings:

between 60.0 and 65.0 wt % of Cu,
between 0.6 and 1.8 wt % of Si,
between 0.2 and 1.5 wt % of Bi,
between 0.02 and 0.5 wt % of Al,
less than 1.5 wt % of Ni+Mn+Sn,
between 0.01 and 0.5 wt % of La—Ce alloy,
between 0.002 and 0.02 wt % of B, and
with the remainder being Zn and inevitable impurities, wherein the total amount of impurities are no more than 0.5 wt %.

2. The lead-free free-cutting corrosion-resistant silicon-bismuth brass alloy of claim 1, wherein, the alloy is consisted of the followings:

between 61.0 and 64.0 wt % of Cu,
between 0.8 and 1.4 wt % of Si,
between 0.25 and 0.6 wt % of Bi,
between 0.04 and 0.25 wt % of Al,
less than 1.0 wt % of Ni+Mn+Sn,
between 0.02 and 0.3 wt % of La—Ce alloy,
between 0.002 and 0.012 wt % of B, and
with the remainder being Zn and inevitable impurities, wherein the total amount of impurities are no more than 0.5 wt %.

3. The lead-free free-cutting corrosion-resistant silicon-bismuth brass alloy of claim 2, wherein, the alloy is consisted of the followings:

between 62.0 and 64.0 wt % of Cu,
between 0.9 and 1.3 wt % of Si,
between 0.25 and 0.45 wt % of Bi,
between 0.05 and 0.2 wt % of Al,
less than 0.9 wt % of Ni+Mn+Sn,
between 0.025 and 0.2 wt % of La—Ce alloy,
between 0.003 and 0.01 wt % of B, and
with the remainder being Zn and inevitable impurities, wherein the total amount of impurities are no more than 0.5 wt %.

4. The lead-free free-cutting corrosion-resistant silicon-bismuth brass alloy of claim 1, wherein, the alloy is consisted of the followings:

between 60.5 and 63.5 wt % of Cu,
between 0.6 and 1.5 wt % of Si,
between 0.5 and 1.2 wt % of Bi,
between 0.04 and 0.25 wt % of Al,
less than 1.2 wt % of Ni+Mn+Sn,
between 0.02 and 0.25 wt % of La—Ce alloy,
between 0.002 and 0.012 wt % of B, and
with the remainder being Zn and inevitable impurities, wherein the total amount of impurities are no more than 0.5 wt %.

5. The lead-free free-cutting corrosion-resistant silicon-bismuth brass alloy of claim 4, wherein, the alloy is consisted of the followings:

between 61.0 and 63.0 wt % of Cu,
between 0.6 and 1.2 wt % of Si,
between 0.6 and 1.0 wt % of Bi,
between 0.05 and 0.2 wt % of Al,
less than 0.9 wt % of Ni+Mn+Sn,
between 0.025 and 0.2 wt % of La—Ce alloy,
between 0.003 and 0.01 wt % of B, and
with the remainder being Zn and inevitable impurities, wherein the total amount of impurities are no more than 0.5 wt %.

6. The lead-free free-cutting corrosion-resistant silicon-bismuth brass alloy of claim 1, wherein the impurities have a lead-content of less than 0.01 wt %.

7. The lead-free free-cutting corrosion-resistant silicon-bismuth brass alloy of claim 4, wherein the La—Ce alloy has a Ce-content of 40 wt %.

8. The lead-free free-cutting corrosion-resistant silicon-bismuth brass alloy of claim 4, wherein the sum of amount of Ni+Mn+Sn, that is the sum of amount of Ni, Mn and Sn, is between 0.2 and 0.9 wt %.

9. The lead-free free-cutting corrosion-resistant silicon-bismuth brass alloy of claim 2, wherein the impurities have a lead-content of less than 0.01 wt %.

10. The lead-free free-cutting corrosion-resistant silicon-bismuth brass alloy of claim 3, wherein the impurities have a lead-content of less than 0.01 wt %.

11. The lead-free free-cutting corrosion-resistant silicon-bismuth brass alloy of claim 4, wherein the impurities have a lead-content of less than 0.01 wt %.

12. The lead-free free-cutting corrosion-resistant silicon-bismuth brass alloy of claim 5, wherein the impurities have a lead-content of less than 0.01 wt %.

* * * * *